US012599256B2

(12) United States Patent
Longmeier

(10) Patent No.: US 12,599,256 B2
(45) Date of Patent: Apr. 14, 2026

(54) LIGHTWEIGHT SLEEPING PAD SYSTEM HAVING SEPARABLE AND DISSIMILAR SEGMENTS, AND METHOD OF USING

(71) Applicant: MARY POPPINS UL, LLC, Seattle, WA (US)

(72) Inventor: Geoff Longmeier, Seattle, WA (US)

(73) Assignee: MARY POPPINS UL, LLC, Seattle, WA (US)

( * ) Notice: Subject to any disclaimer, the term of this patent is extended or adjusted under 35 U.S.C. 154(b) by 142 days.

(21) Appl. No.: 18/524,321

(22) Filed: Nov. 30, 2023

(65) Prior Publication Data

US 2025/0176740 A1 Jun. 5, 2025

(51) Int. Cl.

| | |
|---|---|
| ***A47G 9/06*** | (2006.01) |
| ***A47C 27/00*** | (2006.01) |
| ***A47C 27/14*** | (2006.01) |

(52) U.S. Cl.

CPC ..... *A47G 9/062* (2013.01); *A47C 27/001* (2013.01); *A47C 27/146* (2013.01); *A47C 27/148* (2013.01); *A47G 9/06* (2013.01)

(58) Field of Classification Search

CPC ..... A47G 9/062; A47G 9/06; A47G 27/0212; A47G 27/0231; A47G 27/0237; A47C 27/001; A47C 27/142; A47C 27/146; A47C 27/148

USPC ..... 5/417, 420, 722, 723

See application file for complete search history.

(56) References Cited

U.S. PATENT DOCUMENTS

| | | | | | |
|---|---|---|---|---|---|
| 754,329 | A * | 3/1904 | Milliken | A47C 27/001 | D6/601 |
| 4,843,666 | A * | 7/1989 | Elesh | A47C 27/148 | 5/738 |
| 4,868,940 | A * | 9/1989 | Masadi | A47C 27/001 | 428/167 |
| 4,967,428 | A * | 11/1990 | Browder | A47D 15/003 | 5/419 |
| 8,510,878 | B2 * | 8/2013 | Wang | A47G 27/0237 | 5/419 |
| 11,401,730 | B2 * | 8/2022 | Brensinger | A47B 3/06 | |
| D1,104,541 | S * | 12/2025 | Longmeier | D6/596 | |
| D1,104,542 | S * | 12/2025 | Longmeier | D6/596 | |
| 2012/0233772 | A1 * | 9/2012 | Wang | A63B 21/4037 | 5/417 |
| 2020/0305593 | A1 * | 10/2020 | Brensinger | A47B 3/0803 | |
| 2025/0176740 | A1 * | 6/2025 | Longmeier | A47G 9/062 | |

* cited by examiner

*Primary Examiner* — Robert G Santos
(74) *Attorney, Agent, or Firm* — Dilworth & Barrese, LLP

(57) ABSTRACT

A sleep pad system includes an upper segment generally sized and shaped to rest beneath the torso and head of a lying human, and a lower segment generally sized and shaped for the human's lower extremities. The upper segment construction imparts superior cushioning and warmth properties relative to the lower segment. The upper segment is configured for accordion-type folding, thereby allowing transformation into a compact and sturdy article having utility as a structural support. The lower segment is constructed of significantly lighter material than the upper segment, thereby decreasing the overall weight of the system.

16 Claims, 13 Drawing Sheets

LIGHTWEIGHT SLEEPING PAD SYSTEM HAVING SEPARABLE AND DISSIMILAR SEGMENTS, AND METHOD OF USING

BACKGROUND OF THE INVENTION

The present invention relates generally to outdoor equipment, and more particularly, to lightweight sleeping pad systems having separable and dissimilar segments, and methods of using those systems.

Ultralight backpacking ("UL backpacking") is a category of backpacking that emphasizes carrying the lightest and least amount of gear. UL backpacking enthusiasts strive for the lowest reasonable base weight, which is defined as the weight of a loaded pack minus consumables such as food, water and fuel. A low base weight is critical in allowing a backpacker to comfortably cover long distances and to reduce stress on their bodies.

A base weight of less than about 10 lbs. is generally considered to be "ultralight". In contrast, traditional backpackers typically haul base weights of approximately 15 to 30 lbs., and as much as 55 lbs. or more for winter and/or extended trips, or where special equipment is desired.

Various strategies are employed to decrease base weight, including omitting or sharing equipment, using gear that serves multiple purposes, and/or utilizing specialized lightweight gear. Shelter, sleeping systems and the pack itself are generally considered to be the major items amenable to significant weight reduction. It is important to note that, in UL backpacking, "significant" weight reduction can be measured in ounces and grams.

Sleeping pads are generally considered to be an essential component of a UL backpacker's gear. They provide a layer of cushioning and thermal protection between the backpacker and the ground, thereby promoting comfortable and regenerative sleep.

A typical sleeping pad is a unitary rectangular or mummy-shaped segment of foam or comparable material, generally having dimensions similar to a sleeping bag, and usually weighing around 15 oz., which is significant relative the total base weight threshold of less than 10 lbs. Sleeping pads are also bulky. Backpackers often attach and carry rolled up sleeping pads on the outside of their pack to save space within the pack's carrying compartment. Another disadvantage of conventional sleeping pads is that they don't reasonably lend themselves to multiple purposes, largely because they are too flimsy to be provide mechanical stability yet too large and/or inflexible to be conformed into other articles.

As can be seen, there is a need for an improved sleeping pad system that is suitable for UL backpacking. It is desirable that this system is extremely lightweight, lends itself to multiple purposes, and is easy to use.

SUMMARY OF THE INVENTION

A sleep pad system includes an upper segment generally sized and shaped to rest beneath the torso and head of a lying human, a lower segment generally sized and shaped for the human's lower extremities, and a means for attaching the upper segment to the lower segment in an end-to-end orientation. The upper segment and lower segment are separable, with each segment having distinct characteristics and functionality for use without the other segment. In a preferred embodiment the upper segment is constructed of foam, and imparts superior cushioning and warmth properties relative to the foam lower segment upon which the lower extremities rest. The upper segment is preferably configured for accordion-type folding, thereby allowing the upper segment to be transformed into a compact and sturdy article having utility as a structural support, for example as a frame in a frameless ultralight pack. The lower segment, because it is constructed of significantly lighter and/or reduced material than the upper segment, decreases the overall weight of the sleep system. Moreover, it is easily attachable to the outside of the pack making it easily accessible when the upper rigid section is used inside the pack as frame-like support. Further, its compact size and shape lends itself to a variety of purposes including a sitting pad, tent entry mat and/or orderly surface for storing and/or preparing gear and food. The sleep system is configured for use with a variety of auxiliary gear such as pillows, emergency shelters, tents and sun shades.

DETAILED DESCRIPTION OF THE INVENTION

The following detailed description is of the best currently contemplated modes of carrying out exemplary embodiments of the invention. The description is not to be taken in a limiting sense, but is made for the purpose of illustrating the general principles of the invention.

The following structure numbers shall apply to the following structures among the various FIGS.:

10—Sleep system;

12—Reinforcement means;

15—Longer length embodiment;

16—Standard length embodiment;

20—Upper segment;

22—Upper segment attachment means;

24—Upper segment top edge;
25—Upper segment bottom edge;
26—Upper segment left edge;
27—Upper segment right edge;
31—Upper segment upper surface;
32—Upper segment bottom surface;
33—Peak;
34—Pit;
36—Crease;
37—Border;
40—Lower segment;
42—Lower segment attachment means;
44—Lower segment top edge;
45—Lower segment bottom edge;
46—Lower segment left edge;
47—Lower segment right edge;
48—Lower segment upper surface;
49—Lower segment bottom surface;
50—Backpack;
52—Pillow;
54—Shelter; and
56—Supplemental connector.

Broadly, the present invention pertains to outdoor equipment, and more particularly, to lightweight sleeping pad systems having separable and dissimilar segments, and methods of using those systems.

Figure 1:
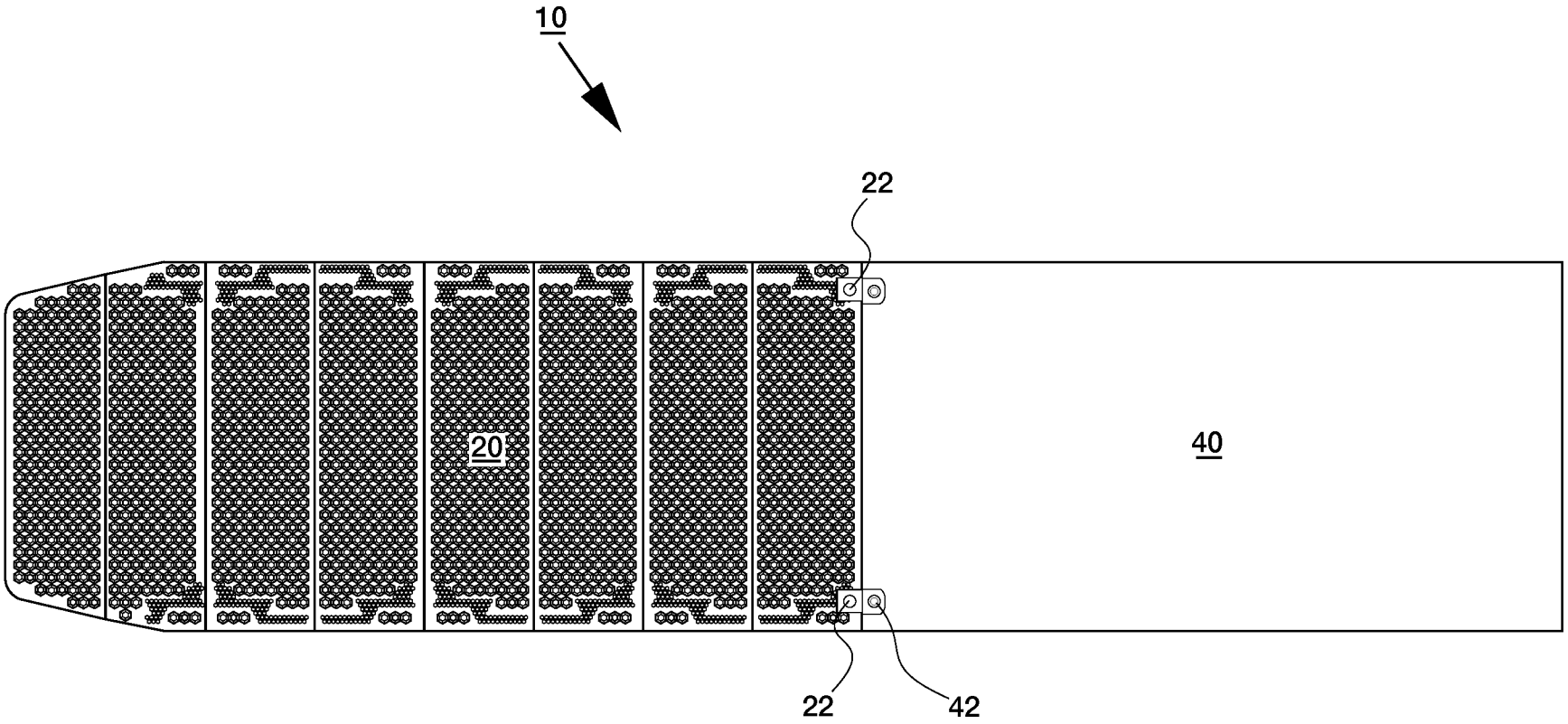
FIG. 1 depicts a top view of a sleep system of the present inventions.

Referring to FIG. 1, sleep system 10 generally includes upper segment 20 releasably engageable with lower segment 40 by at least one attachment means. In this view upper segment attachment means 22 is poised for attachment to corresponding lower segment attachment means 42.

Figure 2:
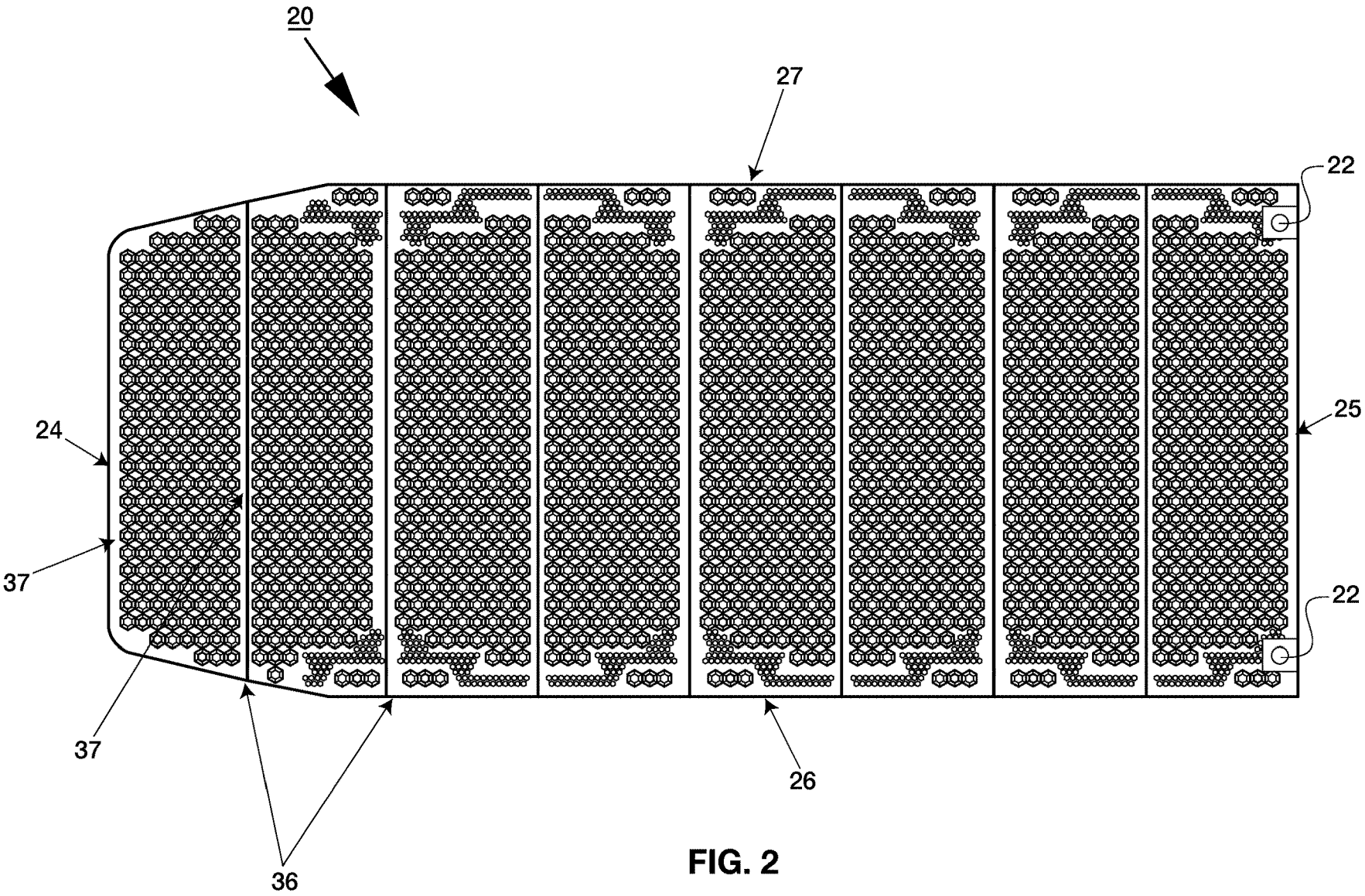
FIG. 2 depicts a top view of an upper segment of a sleep system.
Figure 3:
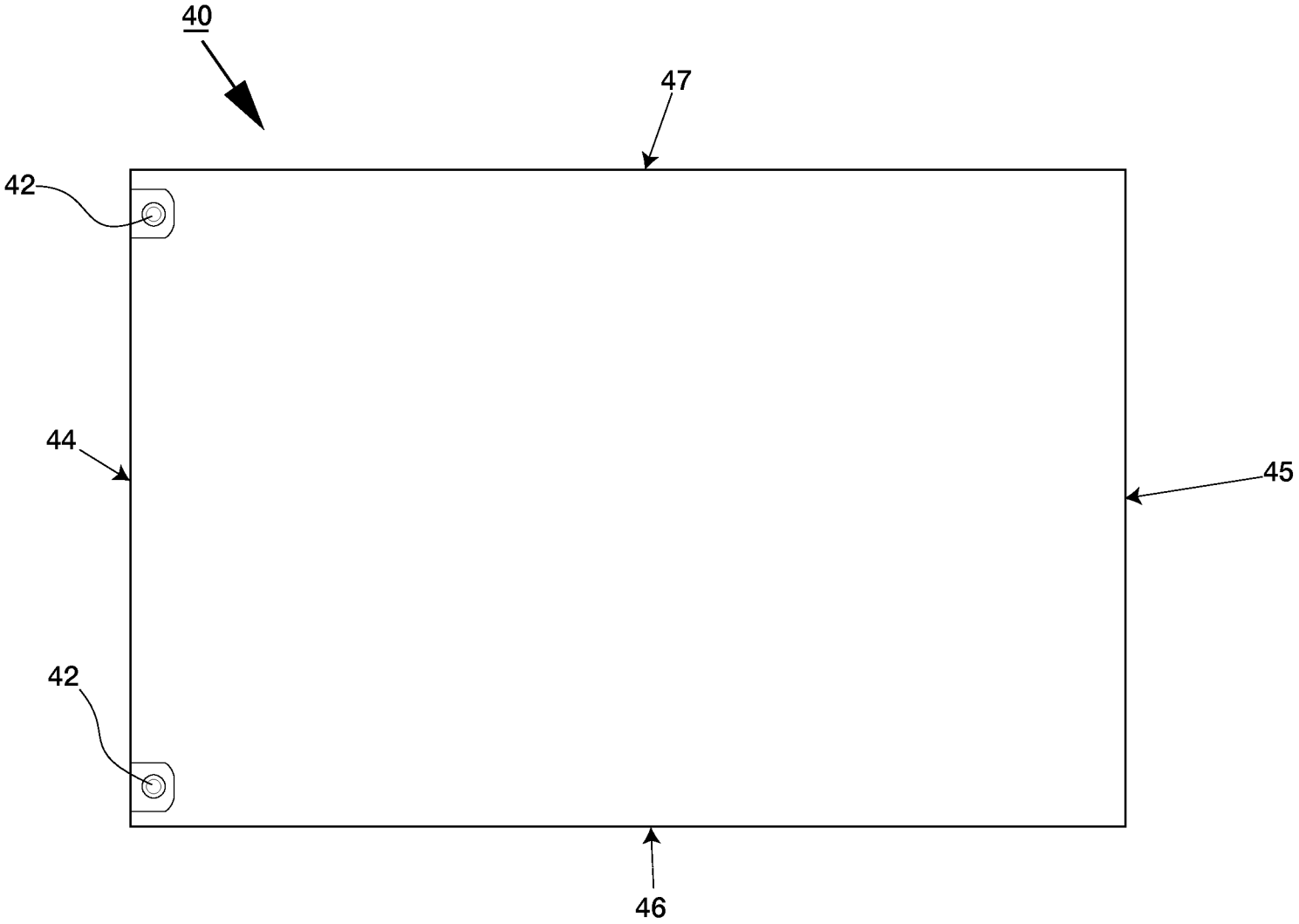
FIG. 3 depicts a top view of lower segment of a sleep system.

FIG. 2 illustrates upper segment 20 in more detail, including upper segment top edge, bottom edge, left edge and right edge 24, 25, 26, 27 respectively, as well as creases 36, along which the upper segment is foldable. A mummy-shaped upper segment is depicted but other shapes are within the scope of the inventions. FIG. 3 illustrates lower segment 40 including lower segment top edge, bottom edge, left edge and right edge 44, 45, 46, 47 respectively.

Sleep system 10 may have a longer length embodiment 15 (FIG. 13) for taller people, and a standard length embodiment 16 (FIG. 14) for average or small people, although it should be understood that the invention encompasses a variety of dimensions, and specific dimensions and ranges are not limiting.

Preferably upper segment 20 is approximately 18"-26" wide thereby allowing for narrow, regular and wide versions as well as differing shapes. The upper segment is preferably approximately 30"-50" long, approximately ½" to 1" thick, weighs approximately 2.5 oz-8.0 oz, and has ~R value of 1-3. In an alternative embodiment an air or a hybrid air and foam pad could be employed for the upper segment, which would impart a thickness of approximately 1"-3" and may increase R value to 3-6. Lower segment 40 is preferably 18"-24" wide by approximately 30"-50" long, approximately ⅛" to ½" thick, weighs approximately 1 oz to 2.5 oz, and has ~R value of 0.25-2. In an alternative embodiment an air or hybrid pad could be employed for the lower segment, which would impart a thickness of approximately 1"-3", and may increase R value to 2-4.

Most preferably the longer length sleep system 10 is approximately 20" wide by approximately 71" long, and weighs approximately 4.3 oz, while the standard length sleep system is approximately 20" wide by approximately 61" long, and weighs approximately 3.5 oz. More specifically, upper segment 20 of the longer length embodiment most preferably measures approximately 20" wide×41" long×⅝" thick, weighs approximately 3.3 oz, and has ~R value of 2. The standard length upper segment preferably measures approximately 20" wide×31½" long×⅝" thick, weighs approximately 2.5 oz, and has an ~R value of 2. In both the longer length and standard length preferred embodiments, lower segment 40 measures approximately 20" wide×31" long×⅛" thick, weighs approximately 1.0 oz, and has an ~R value of 0.5.

Figure 8:
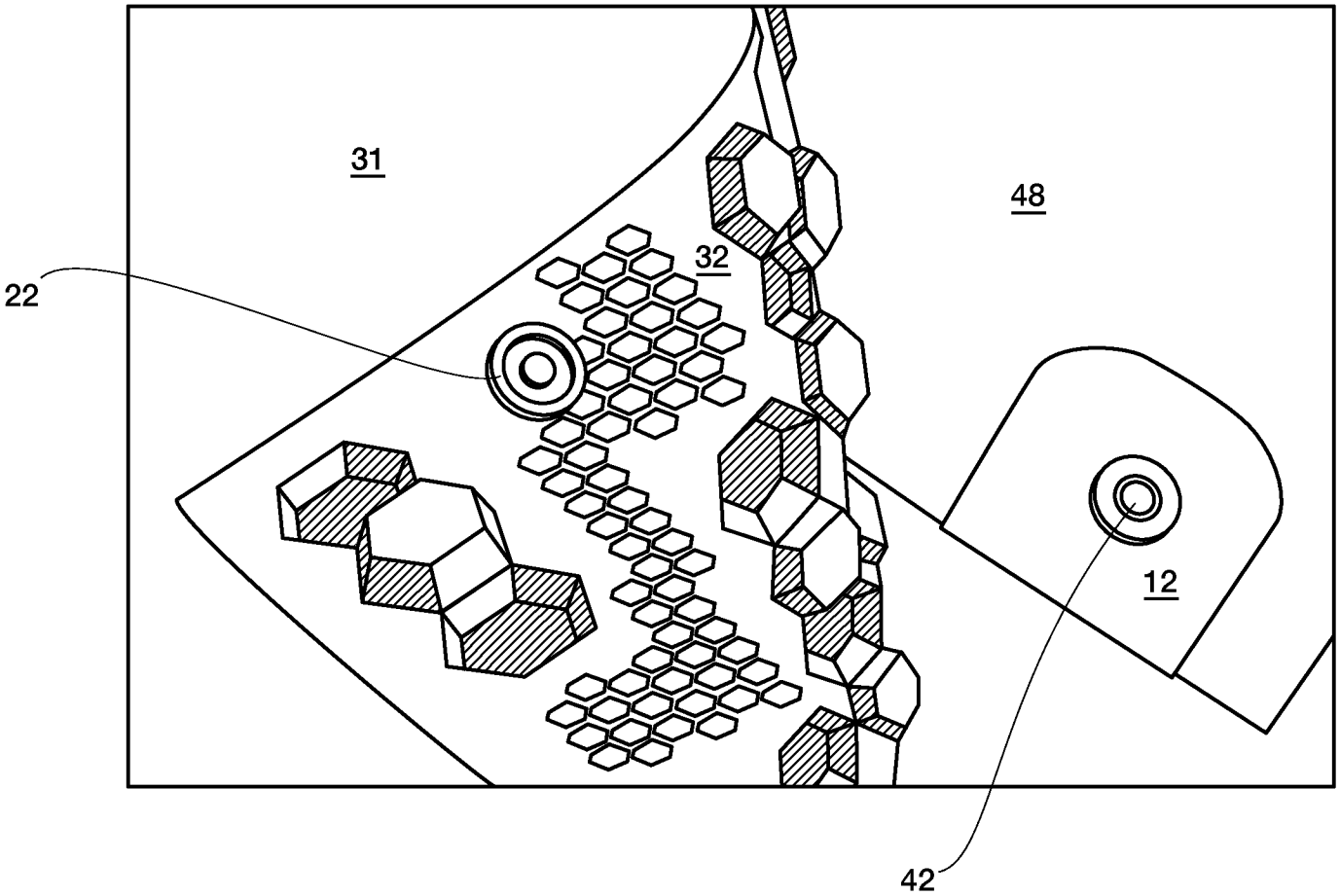
FIG. 8 depicts an upper segment and lower segment poised for attachment.

Upper segment 20 may be constructed of a variety of materials including polyethylene foam, low density polyethylene foam, ethylene vinyl acetate foam, crosslinked polyethylene foam, irradiated crosslinked polyethylene foam, and combinations thereof. Depending on the specific application and target market the upper section is most preferably constructed of EVAZOTE VA35, a closed cell, cross-linked ethylene vinyl acetate copolymer foam; PLASTAZOTE LD ranging from 15-45 kg/m$^3$ a closed cell, cross-linked polyethylene foam; or SUPAZOTE EM26, a closed cell, cross-linked ethylene co-polymer foam; each from Zotefoams Inc. of Walton, Kentucky. The foam material is preferably formed into a substrate having a recurring pattern of peaks 33 and pits 34, each of which is substantially identical in size and shape. It is noted that each indentation is both a peak and a pit. Said another way, a single indentation is deemed a peak when it gives rise to a convex form on upper segment upper surface 31, and deemed a pit when it gives rise to a concave form on upper segment bottom surface 32 (FIG. 8). Each peak/pit has a diameter of approximately ⅝", with the substrate being approximately ¾" thick after press molding. The peak/pits are oriented such that each pit 34 receives a corresponding peak 33 when upper segment 20 is folded along creases 36, best shown in FIG. 10. The resulting folded up structure is both compact and structurally strong. In a preferred embodiment, shown best in FIG. 2, borders 37 of approximately ¼" width are strategically positioned along creases 36 and the perimeter of upper segment 20 in order to facilitate compact folding. While the figures depict upper segment 20 having six and eight folding panels for the short and standard length pads respectively, the number of panels may vary. By way of example, three and four folded panels are within the scope of the invention.

Lower segment 40 may be constructed of a variety of materials including polyethylene foam, low density polyethylene foam, ethylene vinyl acetate foam, crosslinked polyethylene foam, irradiated crosslinked polyethylene foam, and combinations thereof. Most preferably the lower segment is constructed of EVAZOTE VA35, a closed cell, cross-linked ethylene vinyl acetate copolymer foam from Zotefoams Inc. of Walton, Kentucky, although similar foams are also within the scope of the invention. The foam material is preferably cut flat without press molding to allow for maximum flexibility.

In a preferred embodiment the upper segment is more rigid and has a higher R value than the lower segment. It is noted, however, that the rigidity and R values don't necessarily correspond with the inherent properties of the foam that the segments are constructed of. By way of example, in a preferred embodiment the upper segment is constructed of SUPAZOTE EM26 which has a density of 26 kg/m3, and the lower segment is constructed of EVAZOTE VA 35 which has a density of 35 kg/m3. The upper segment is constructed of lower density foam, but is thicker, perhaps employing >¼" of foam which is heated and press molded. Conversely, the lower segment is constructed with only approximately ⅛th inch of foam which is cut flat with no molding. The result is that the upper segment, although constructed of less dense foam, is more rigid and has a higher R value than the bottom segment which is lighter, more flexible and has a lower R value.

Figure 5:
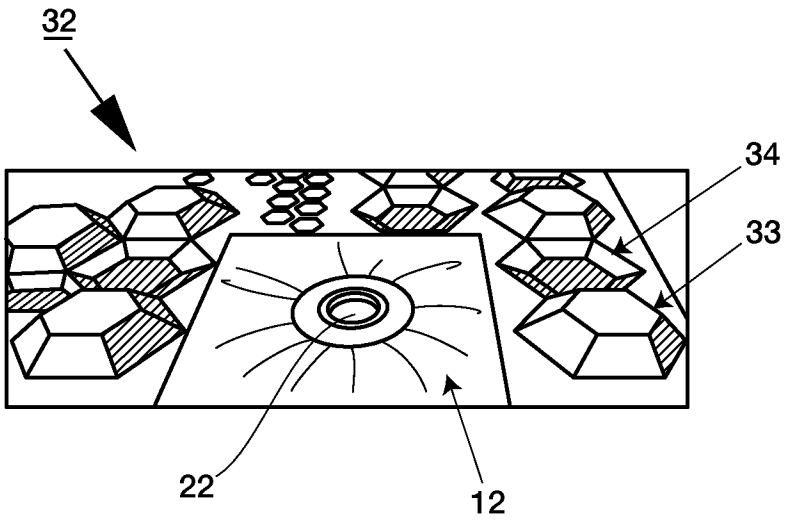
FIG. 5 depicts a close-up view of a portion of an upper segment bottom surface.
Figure 4:
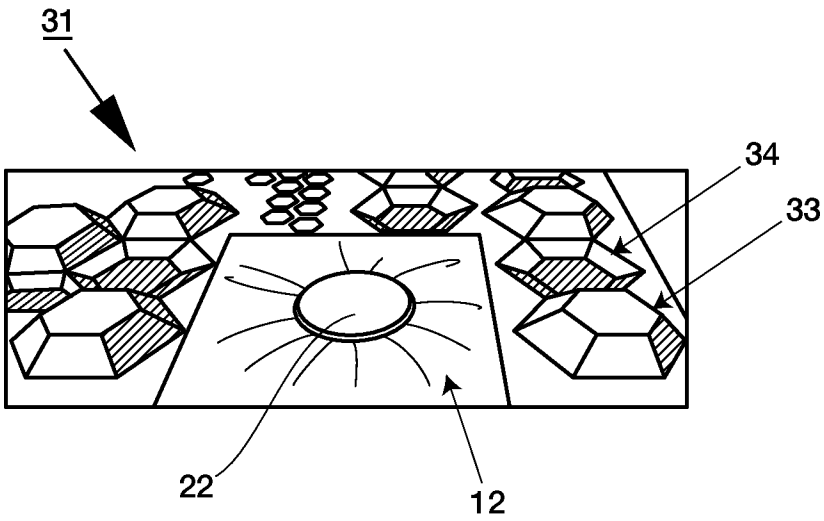
FIG. 4 depicts a close-up view of a portion of an upper segment upper surface.
Figure 7:
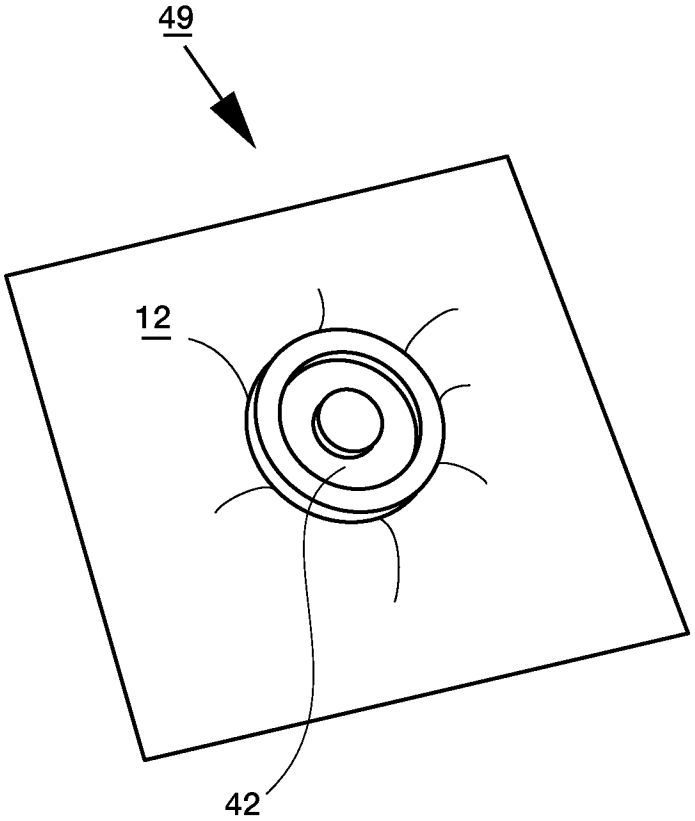
FIG. 7 depicts a close-up view of a portion of a lower segment upper surface.
Figure 6:
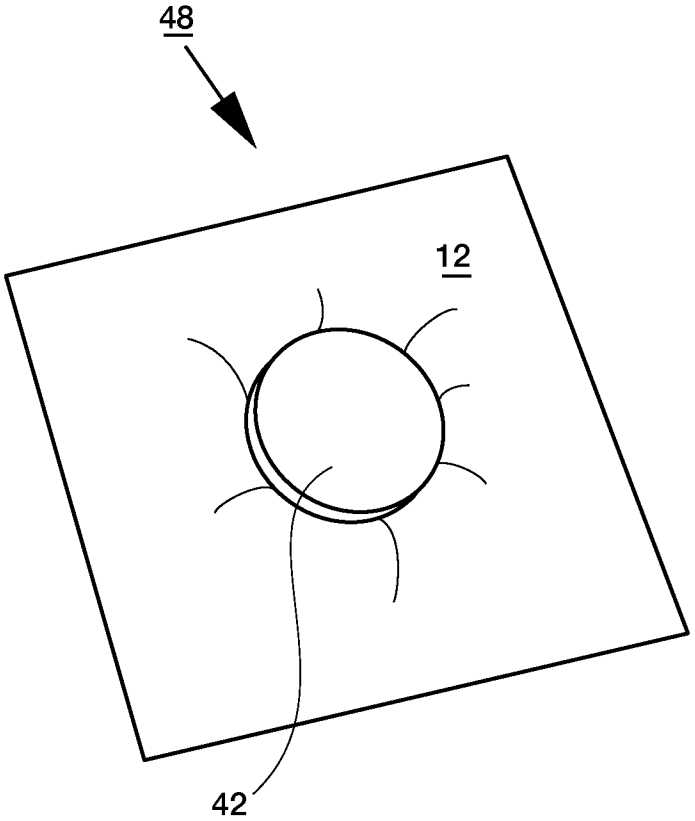
FIG. 6 depicts a close-up view of a portion of a lower segment bottom surface.
Figure 9:
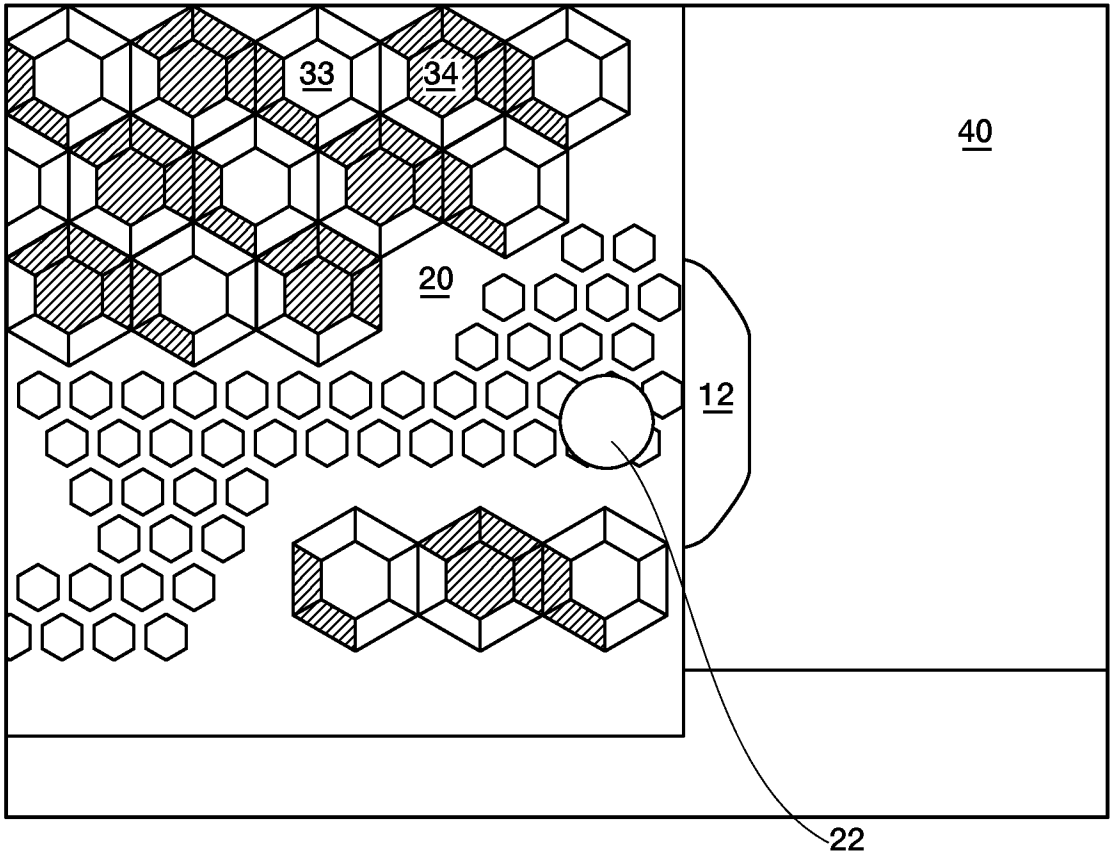
FIG. 9 depicts an upper segment and lower segment attached.

FIGS. 4 and 5 depict upper segment upper surface and upper segment bottom surface 31, 32 respectively, which would be the surfaces upon which a user would sleep in ordinary use. Each segment includes mating attachment means 22 attached thereto, each of which are configured and positioned to releasably engage one to the other to keep the segments attached one to the other as desired. This is depicted in FIGS. 8 and 9. In a preferred embodiment, depicted herein, attachment means 22 is a button snap, and most preferably a KAM brand T5 (12 mm) size 20 resin plastic button snap or similar button snap, but it should be understood that other attachment means, including magnetic fasteners (preferably approximately ½"), metal snaps (preferably approximately ¼" to ⅜" in diameter), eyelets and grommets (preferably less than approximately 1"), hook and loop strips (preferably ranging from approximately ½" to 2" wide up to the length of the pad), elastic cords (preferably approximately 1" to 36"), ties and straps (preferably approximately 1" to 8"), tongue and groove connectors (preferably ranging from approximately ½" to the length of the pad), and zippers are within the scope of the inventions. The particular attachment means employed is preferably selected based on a variety of factors including the level of holding strength needed for the particular foam(s) used, and the force needed for release. By way of example a T5 size 20 button snap may exhibit sufficient holding strength and be releasable with reasonable force for a given foam, but a size 20 button snap may be too heavy or light duty for other foams or alternative materials.

Referring to FIGS. 4-9, some pad materials may need reinforcement to prevent the attachment means from damaging, distorting or otherwise undesirable affecting the underlying substrate, particularly with lighter weight foams. Accordingly, it may be desirable to incorporate reinforcing means 12 to help secure the attachment means to the underlying segment. Various reinforcing means include tape, adhesive tape, nylons, polyesters, polymers, and other synthetic, non-synthetic or hybrid materials applied with adhesive, heat, pressure or other binding means including sewing or combinations of these application means. Also, reinforcing means 12 may be foam substrate itself which has been strengthened in the foam pressing process.

Figure 10:
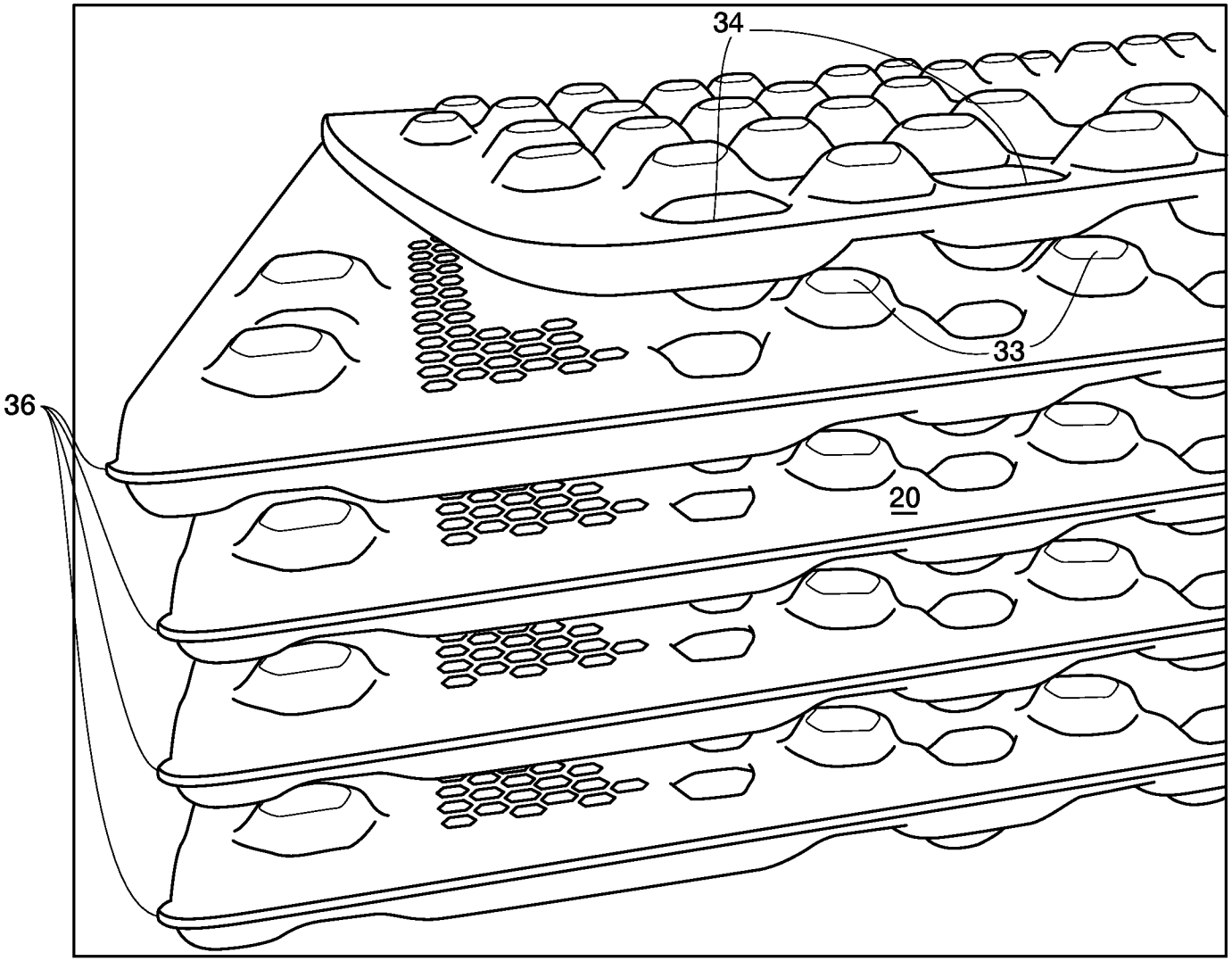
FIG. 10 depicts an upper segment folded.
Figure 11:
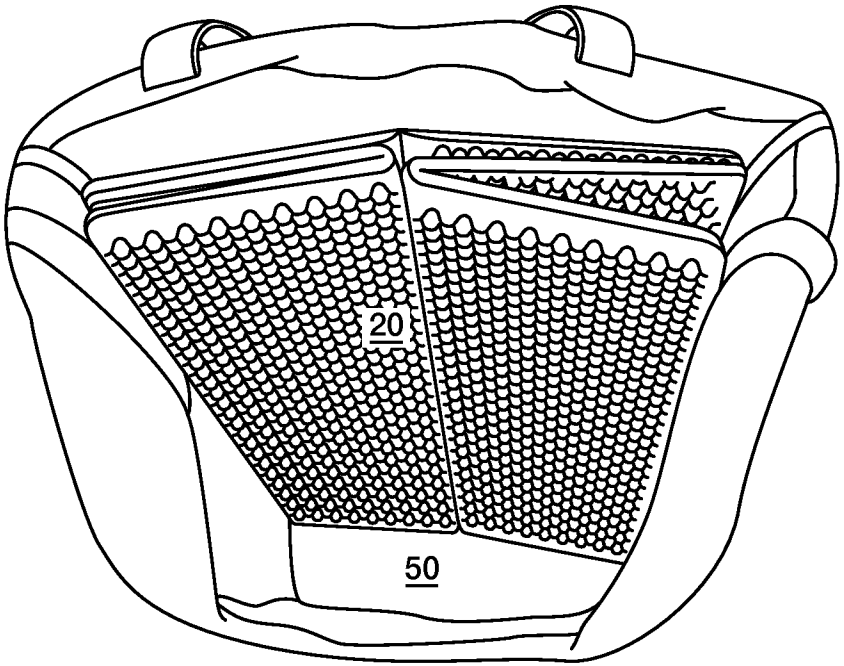
FIG. 11 depicts an upper segment positioned in a backpack.
Figure 12:
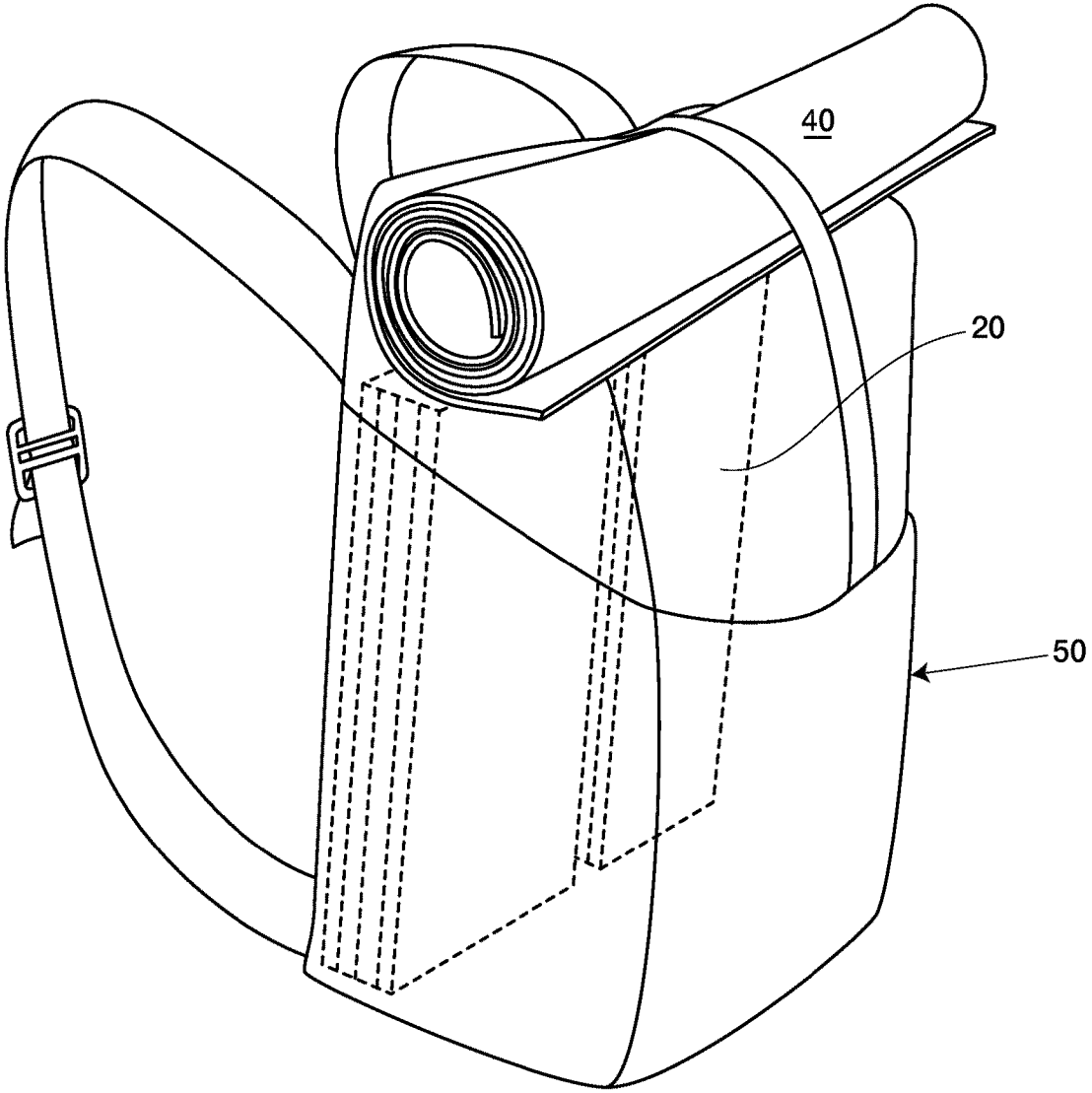
FIG. 12 depicts a disassembled sleep system in a backpack.

Referring now to FIG. 10, one advantage of upper segment 20 comprising an array of peaks 33 aligned with corresponding pits 34 is that when the upper segment is folded the peaks substantially fit within the pits, thereby lending the overall upper segment to a compact and resilient structure. The resulting folded upper segment, whether folded in a single or double accordion or otherwise, may be used in a variety of manners including as a sitting pad, wind shield for camp stove, or as a support structure within backpack 50, particularly where the backpack is an ultralight frameless pack which typically sacrifices structure for weight. The utility of folded upper segment 20 is also depicted in FIG. 12.

Figure 14:
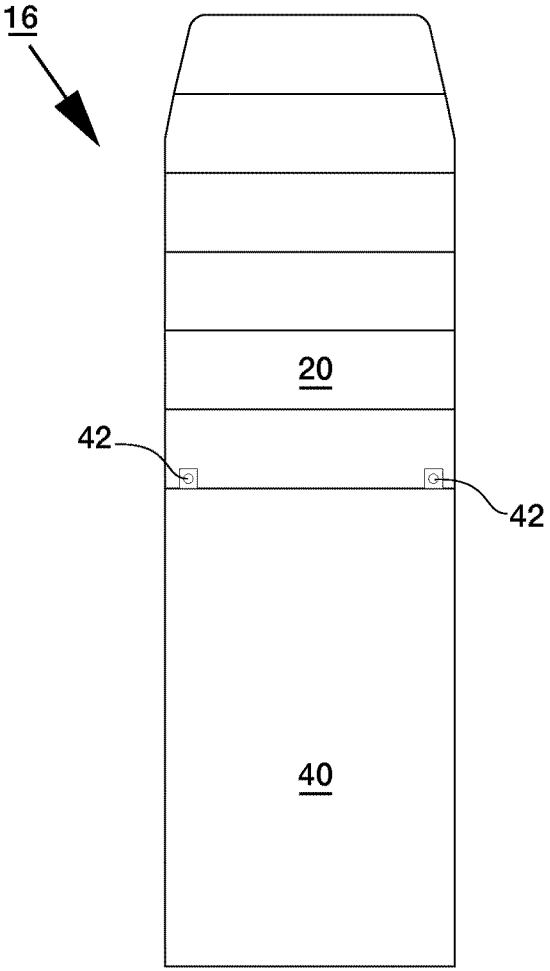
FIG. 14 depicts a standard length embodiment of the present invention.
Figure 13:
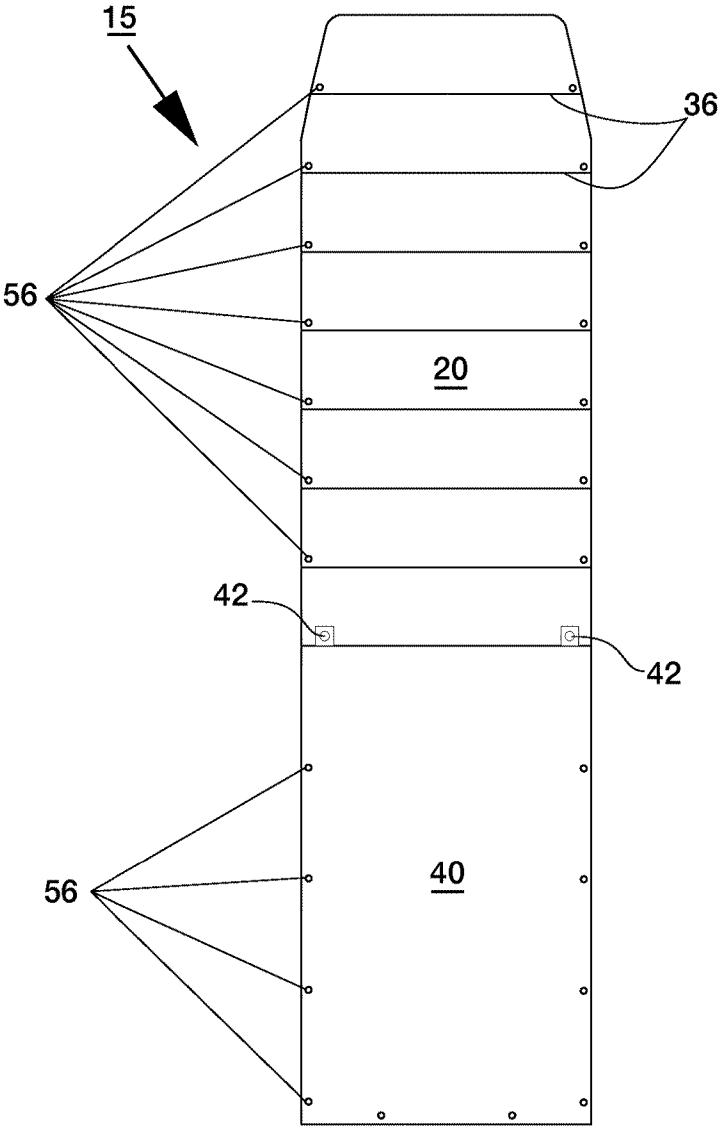
FIG. 13 depicts a longer length embodiment of the present invention.

FIGS. 13 and 14 depict longer length embodiment 15 and standard length embodiment 16, with each including a plurality of creases 36. It is noted that in comparing these two embodiments that upper segments 20 vary in length with respect to size, shape and number of creases, and that associated lower segments 40 are substantially identical in length. However, it should be understood that the overall length of sleep system 10 could also be varied by employing different length upper segments 20 only, or different length upper and lower segments together.

Figure 15:
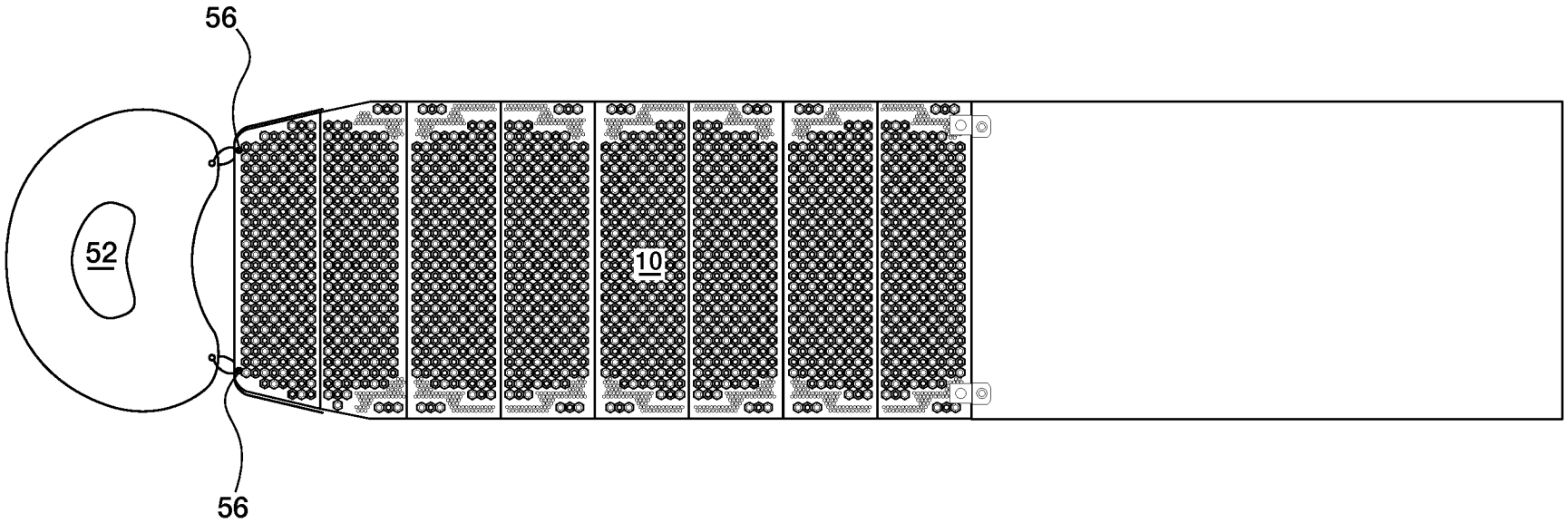
FIG. 15 depicts a pillow connected to a sleep system embodiment.
Figure 16:
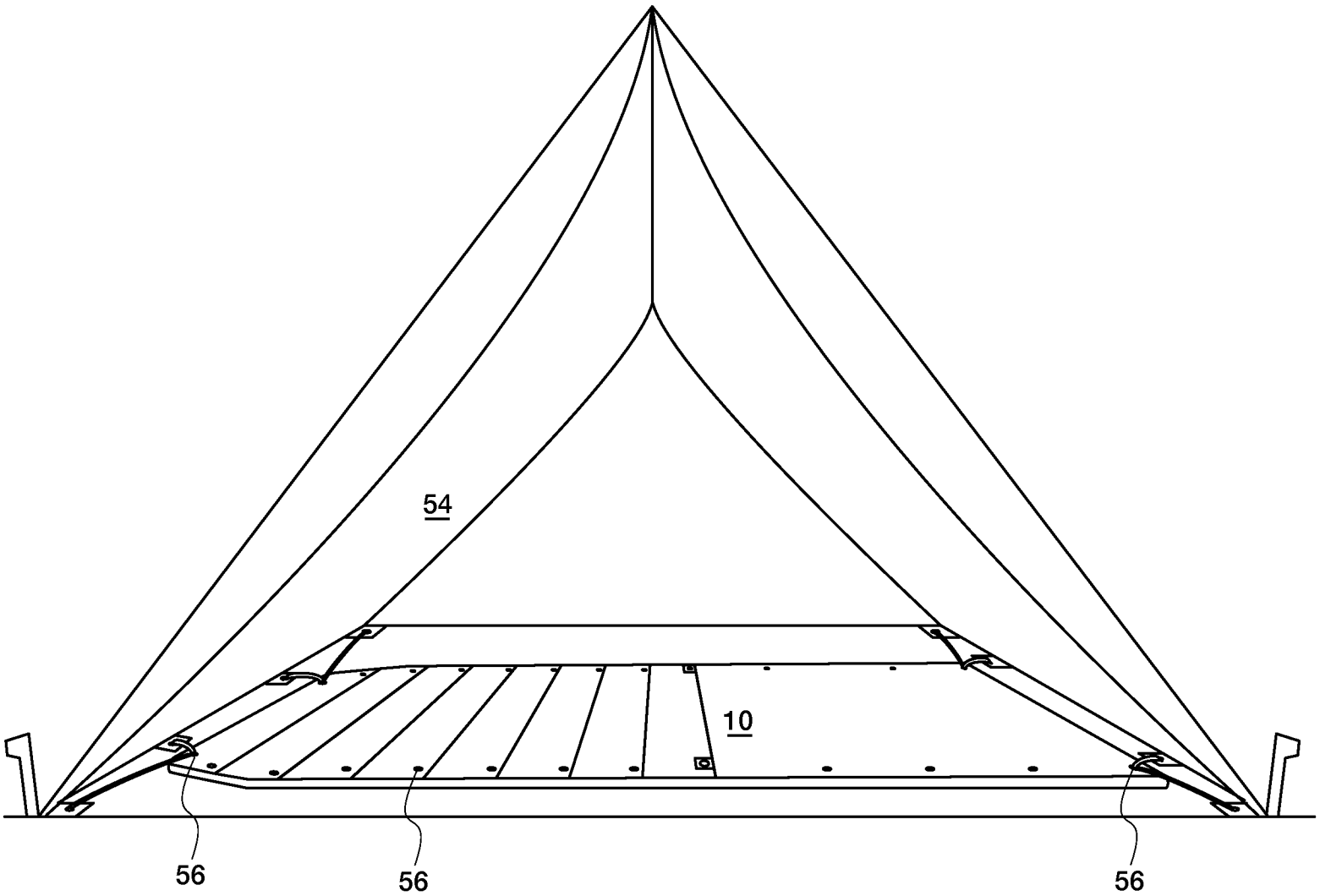
FIG. 16 depicts a sleep system embodiment connected to a shelter.

Referring still to FIG. 13, an alternative embodiment of the sleep system can include a plurality of supplemental connectors 56. It is noted that supplemental connectors could be employed with any embodiment, and is not limited to usage with longer length embodiment 15 specifically. Supplemental connectors 56 can be used to releasably attach another sleep system in order to create a doubly wide system amenable for use by a couple. Supplemental connectors may also be used to releasably connect an array of auxiliary structures such as pillow 52 of FIG. 15 and shelter 54 of FIG. 16. Examples of other auxiliary structures within the scope of this invention include emergency shelters, sunshades, tarps, tents, sleeping bag overlays, and umbrellas. Trekking poles (not shown) may also be incorporated into auxiliary structures for additional versatility. Supplemental connectors may also be employed to repurpose one or both segments of the sleep system. By way of example lower segment 40 may be contorted into a dome-like structure and attached to a poncho to serve as a hood, to a backpack to serve as a rain cover, worn around waist as a rain skirt, or around torso area as emergency insulation. Repurpose uses may employ mating connectors that allow each upper and lower segment to connect onto themselves in addition to mating the upper and lower segments together. For example, using one male and one female T5 button snap on each upper and lower embodiment will allow the upper and lower pads to connect as well as each pad to independently snap to itself creating additional functionality.

Certain structures and components are disclosed for purposes of describing an embodiment, and setting forth the best mode, but should not be construed as teaching the only possible embodiment. Rather, modifications may be made without departing from the spirit and scope of the invention as set forth in the following claims. Examples of modifications include use of hybrid, newly developed, or natural materials that may decrease weight or increase functionality including rigidity, integrity, comfort, R value, and compactness of size. Other modification may simply enhance the form and look of the system. In addition, one or both upper and lower segments may be adapted for different weather types or seasonal conditions, for example a three season or winter version may change the size, thickness, R value, or materials of the embodiment while maintaining the spirit and scope of the invention. Similarly, the function of the upper and lower segments may change for example the lower section may be more rigid making it useful as structural support, with an upper segment compose of an air or hybrid pad that has flexible characteristics of the said lower segment. In addition, modifications may be made to adapt the pad system for specific user groups for example trail runners, fastpackers, thru-hikers, bikepackers, hunters, military personnel, and other recreational and professional users. For example, in the case of trail runners the upper and lower segments could be modified to serve as a pack like structure and strapping vest themselves removing in part or whole the need for what is traditionally thought of as a stand-alone pack. While separable and dissimilar segments are typical in this invention it does not exclude the use of the same material in both the upper and lower segment. For example, a releasably connected embodiment of identical foam pressed with peaks and pits and with accordion like folds can make more optimal use of each segment compared to an otherwise inseparable embodiment, and in this example having the same upper and lower segment materials could be the best choice for each of the multiple uses that arise when separation with attachment means of the embodiment is allowed. It should be understood that all specifications, unless otherwise stated or contrary to common sense, are +/−10%, and that ranges of values set forth inherently include those values, as well as all increments between. Also, "substantially" as used herein, shall mean generally. By way of example a "substantially planar" surface includes surface imperfections but is generally planar.

What is claimed is:

1. A sleep system including:

a. An upper segment having an upper surface and a bottom surface, said upper segment defining a plurality of peaks and pits wherein each peak defined by said upper surface is congruous with a corresponding pit defined by said bottom surface;

b. An attachment means connected with said upper segment, and;

c. A lower segment releasably connected to said upper segment, by said attachment means, wherein said upper segment and said lower segment are connected in an end-to-end orientation, and wherein said upper segment and said lower segment have different material properties in order to provide different cushioning and warmth properties for a user of the sleep system.

2. The sleep system of claim 1 wherein said upper segment has an R value equal or greater than the R value of said lower segment.

3. The sleep system of claim 2 wherein said upper segment has an R value of approximately 1 to approximately 3.

4. The sleep system of claim 3 wherein said lower segment has an R value of approximately 0.25 to approximately 2.

5. The sleep system of claim 1 wherein said upper segment defines a plurality of creases configured to fold a first section of said upper segment relative to a second section of said upper segment, each of said creases surrounded by a border devoid of said peaks and said pits.

6. The sleep system of claim 5 wherein said peaks of said first section enter said pits of said second section.

7. The sleep system of claim 1 further including a supplemental connector releasably engageable with an auxiliary structure selected from the group consisting of pillows, shelters, sunshades, tarps, tents, sleeping bag overlays, umbrellas, ponchos and combinations thereof.

8. An ultralight backpacking system including:

a. A frameless backpack having an interior compartment;

b. A sleep system including an upper segment folded along a plurality of creases, said upper segment positioned within said interior compartment; and c. a lower segment releasably engageable with said upper segment in an end-to-end orientation, and wherein said upper segment provides structural integrity to said frameless backpack and wherein said upper segment and said lower segment have different material properties in order to provide different cushioning and warmth properties for a user of the ultralight backpacking system.

9. The ultralight backpacking system of claim 1 wherein said upper segment is constructed of foam.

10. The ultralight backpacking system of claim 9 wherein said upper segment has an R value of approximately 1 to approximately 3.

11. The ultralight backpacking system of claim 1 wherein said lower segment weighs approximately 1 oz to approximately 2.5 oz.

12. A method of ultralight backpacking including the acts of:

a. Folding the upper segment of a sleep system along a plurality of creases;

b. Positioning said upper segment within the compartment of a frameless backpack;

c. Traveling to a site;

d. Releasably engaging said upper segment to a lower segment in an end-to-end orientation to form a sleep system; and e. Lying on said sleep system, wherein said upper segment and said lower segment have different material properties in order to provide different cushioning and warmth properties for a user of the ultralight backpacking method.

13. The method of claim 12 further including the act of releasably engaging an auxiliary structure selected from the group consisting of pillows, shelters, sunshades, tarps, tents, sleeping bag overlays, umbrellas, ponchos and combinations thereof.

14. The method of claim 13 further including the act of releasably engaging a trekking pole with said auxiliary structure.

15. The method of claim 12 wherein said act of folding said upper segment includes folding said upper segment in an accordion configuration.

16. The method of claim 15 wherein said act of folding said upper segment includes mating a plurality of peaks with a plurality of pits.

* * * * *